US005540606A

United States Patent [19]

Strayhorn

[11] Patent Number: 5,540,606

[45] Date of Patent: Jul. 30, 1996

[54] ADJUSTABLE STEERING APPARATUS FOR OUTBOARD MOTORS

[75] Inventor: Eddie J. Strayhorn, Austin, Tex.

[73] Assignee: Leslie O. Paull, Austin,, Tex.

[21] Appl. No.: 494,161

[22] Filed: Jun. 23, 1995

[51] Int. Cl.[6] ..... B63H 5/12

[52] U.S. Cl. ..... 440/63; 440/6; 114/144 R

[58] Field of Search ..... 440/6, 7, 53, 63, 440/900; 74/494, 480 B; 114/146, 144 R, 172

[56] References Cited

U.S. PATENT DOCUMENTS

| | | | |
|---|---|---|---|
| 1,161,935 | 11/1915 | Heck et al. | 440/63 |
| 1,192,377 | 7/1916 | Blakely | 440/63 |
| 1,683,893 | 9/1928 | Irgens | 440/63 |
| 2,655,891 | 10/1953 | Gorski | 440/63 |
| 3,382,837 | 5/1968 | Aumack | 440/63 |
| 3,989,000 | 11/1976 | Foley, Jr. | 114/144 R |
| 4,130,079 | 12/1978 | Rhorer et al. | 114/146 |
| 4,241,684 | 12/1980 | Davis | 114/172 |
| 4,521,201 | 6/1985 | Watanabe | 440/63 |
| 4,622,015 | 11/1986 | Sumigawa | 440/55 |

FOREIGN PATENT DOCUMENTS

| | | | |
|---|---|---|---|
| 8202194 | 11/1983 | Japan | 440/63 |

*Primary Examiner*—Edwin L. Swinehart

*Attorney, Agent, or Firm*—Russell D. Culbertson; Shaffer & Culbertson

[57] ABSTRACT

A steering handle is pivotally connected to an outboard boat motor so that the handle may pivot freely with respect to the motor about a motor steering axis. A handle engagement arrangement allows the handle to be fixed at a particular orientation on the motor and released as desired to move to another orientation about the motor. The handle engagement arrangement preferably includes a control device positioned at a distal end of the handle. The adjustable handle arrangement allows the motor to be turned 360 degrees while maintaining the steering handle within reach and in a convenient position.

8 Claims, 2 Drawing Sheets

ADJUSTABLE STEERING APPARATUS FOR OUTBOARD MOTORS

BACKGROUND OF THE INVENTION

This invention relates to outboard boat motors and particularly to an adjustable steering apparatus that enables the boat motor to be turned conveniently through large angles and enables the steering position to be modified as desired.

Outboard boat motors, particularly small electrically powered motors, are used in fishing boats to quietly position the boat around brush, bottom features, and other features that may be fished. These outboard motors include, a drive assembly and an extension that extends upwardly from the water when the drive assembly is submerged for operation. A suitable mounting mechanism connects to the motor extension member and allows the motor extension member to rotate about its longitudinal axis or steering axis to direct the thrust of the drive assembly. Also, the mounting mechanism includes a tilt or other device that allows the drive assembly to be raised out of the water as desired, such as when the boat is propelled by the main engine.

Prior fishing or trolling motors included a steering handle rigidly attached to the motor extension. The handle was used to pivot the extension about the steering axis and thereby direct the thrust of the drive assembly. The handle also oftentimes included power controls for controlling the output of the drive assembly. To operate the motor in the prior steering systems, the operator simply reached over to the handle and moved the handle to direct the thrust of the drive assembly, and controlled the thrust through controls either mounted on the handle itself or elsewhere.

A problem arose with the prior fishing motors when it was desired to reverse the thrust or change the direction of thrust substantially. Since such motors were usually not capable of mechanically reversing the thrust, the motor had to be turned 180 degrees to reverse thrust from a given position. However, pivoting the drive assembly 180 degrees about the steering axis required moving the handle 180 degrees and this changing position placed the handle inconveniently out of reach and oftentimes well over the side of the boat. Also, aside from having to turn the motor through large angles periodically, steering often required moving the handle to an inconvenient position away from where the operator was sitting. The operator often had to either change positions in the boat or lean inconveniently one direction or another in order to reach the handle and steer the boat.

SUMMARY OF THE INVENTION

It is therefore an object of the invention to provide a steering apparatus for outboard boat motors that overcomes the above-described problems and others associated with prior steering devices. More particularly, it is an object of the invention to provide a steering mechanism that can be adjusted to substantially any orientation with respect to the line of thrust applied by the motor.

To accomplish these objects, a steering apparatus according to the invention includes a handle which is pivotally connected to the extension of the motor. The handle is free to pivot with respect to the motor extension about the steering axis. The apparatus further includes a handle engagement mechanism associated with the handle and the extension member to fix the handle in a particular position with respect to the extension member so that the handle may turn the extension member, and therefore the motor drive assembly. The handle engagement mechanism also allows the handle to be released from a particular orientation and moved to another orientation with respect to the extension member without turning the extension member and motor drive assembly about the steering axis.

The preferred handle engagement mechanism includes a control lever positioned at a distal end of the handle, a sprocket or similar device connected to the motor extension member, an indexing member mounted on the handle and adapted to cooperate with the sprocket, and a cable connecting the control lever and the indexing member. With the indexing member in an extended position, it extends between the teeth on the sprocket and fixes the handle in a particular orientation with respect to the motor extension member. The control lever may be used to retract or withdraw the indexing member from between the sprocket teeth to enable the handle to be pivoted with respect to the motor extension member and then reset in a different orientation.

The adjustable steering mechanism according to the invention allows the thrust of the motor to be directed in any direction 360 degrees about the steering axis while always maintaining the handle in a convenient steering position. To move the motor about a large angle, the operator simply moves the handle to a convenient position, then releases the handle and returns the handle in the opposite direction until it is convenient to re-engage the handle. At this point, the handle again can be moved to pivot the motor further about the steering axis. This process can be repeated as many times as necessary to conveniently move the motor through a large angle. Also, even when it is not necessary to move the motor through a large angle to steer the boat, the orientation of the handle may be adjusted to any desired orientation about the motor extension member to put the handle in a convenient position for steering.

These and other objects, advantages, and features of the invention will be apparent from the following description of the preferred embodiments, considered along with the accompanying drawings.

DESCRIPTION OF THE PREFERRED EMBODIMENTS

Figure 2:
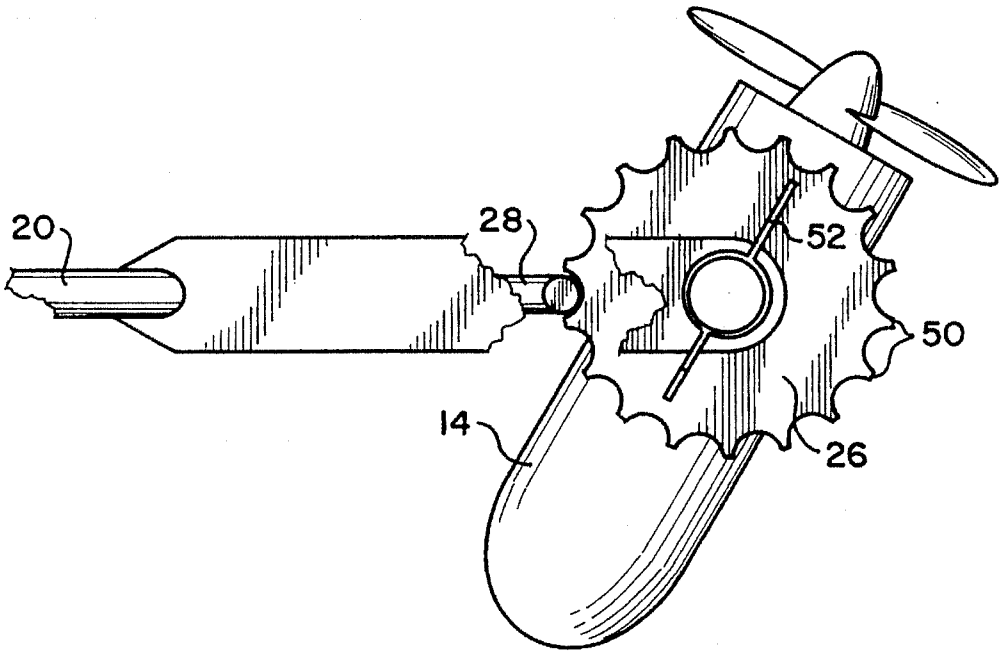
FIG. 2 is a partially broken away top plan view of the apparatus shown in FIG. 1.
Figure 1:
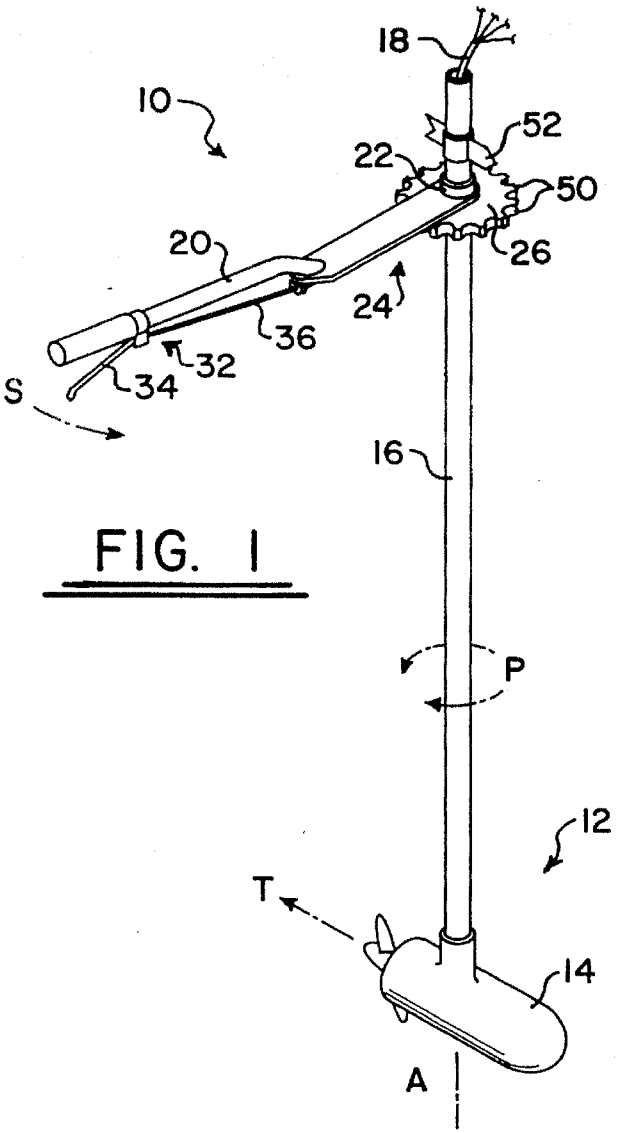
FIG. 1 is an isometric drawing showing a steering apparatus embodying the principle of the invention and a boat motor to be steered with the apparatus.

Referring to FIG. 1 the adjustable steering apparatus 10 is adapted to steer a boat motor 12 that includes a bottom drive assembly 14 and an extension member 16. Although not shown in the drawings, those skilled in the art will appreciate that the boat motor 12 will be supported on a mount structure connecting the motor to a boat and enabling the drive assembly 14 to be lowered into the water with the extension member 16 extending substantially vertically. The boat motor mount may include a tilt mechanism or some other type of structure allowing the drive assembly 14 to be withdrawn from the water and in any event allowing the motor 12 to be pivoted in the direction shown by arrows P about a steering axis A, which coincides with the longitudinal axis of the extension member 16 in the illustrated example. The illustrated boat motor 12 is electrically powered and is controlled through electrical connections 18 extending through the extension member 16 and controlling the motor to provide a desired thrust in the direction T shown in FIG. 1.

The steering apparatus 10 according to the invention includes an elongated handle 20, a pivot connection 22 connecting the handle to the motor extension member 16, and engagement means 24 associated with the handle and with the boat motor extension member. The pivot connection 22 between the handle 20 and the boat motor extension member 16 allows the handle to pivot freely about the extension member about the steering axis as indicated by arrows S in FIG. 1. The handle engagement means 24 operates to fix the handle 20 in a desired position about the boat motor extension member 16 so that the motor 12 may be steered using the handle. Also, the handle engagement means 24 allows the handle 20 to be disengaged or released from a particular orientation about the extension member 16 so that the handle may pivot freely as indicated by arrows S in FIG. 1 and re-engaged in another position.

Referring to FIGS. 1–4, the preferred engagement means or mechanism 24 includes a sprocket 26, an indexing member 28, biasing means 30 for the indexing member, and position control means 32 for the indexing member. The indexing member position control means 32 preferably includes a control lever 34 pivotally connected at a distal end of the handle 20, and a cable 36 connected at one end to the indexing member 28 and at the opposite end to a proximal end of the control lever 34. The indexing member 28 is mounted on the handle 20 within a mounting bracket 40 and adapted for movement axially as indicated by arrows I in FIGS. 3 and 4. The indexing member biasing means 30 comprises a spring acting between the mounting bracket 40 and a collar 42 secured to the indexing member 28. The sprocket 26 is mounted on the boat motor extension member and lies in a plane substantially perpendicular to the steering axis A.

Figure 3:
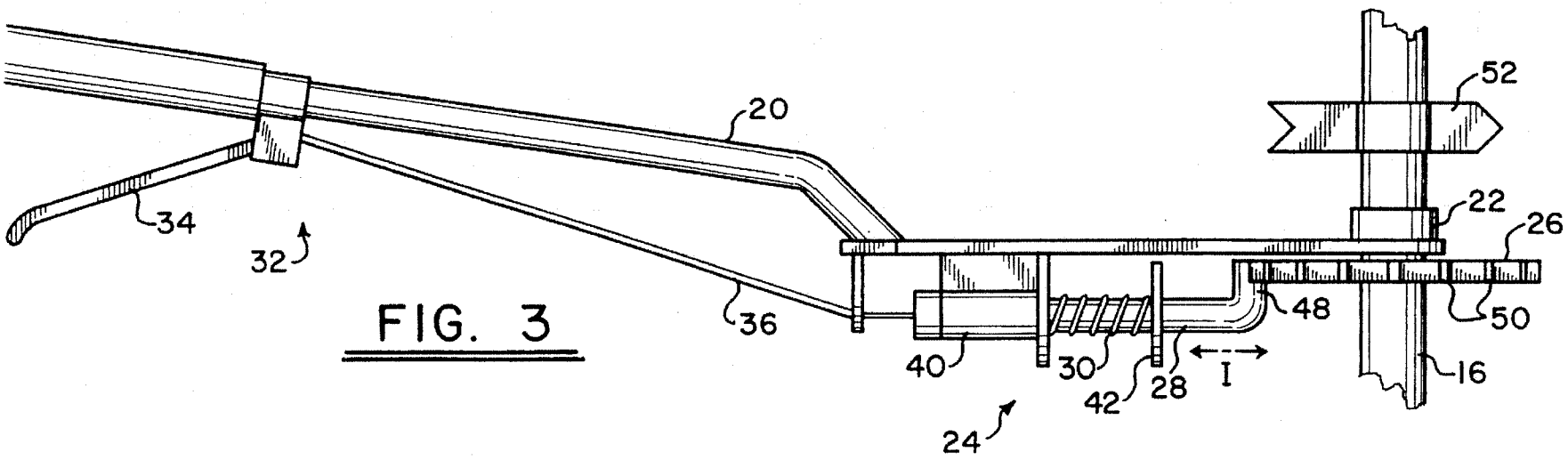
FIG. 3 is a side view of the steering apparatus shown in FIG. 1 with the indexing member in an extended position.
Figure 4:
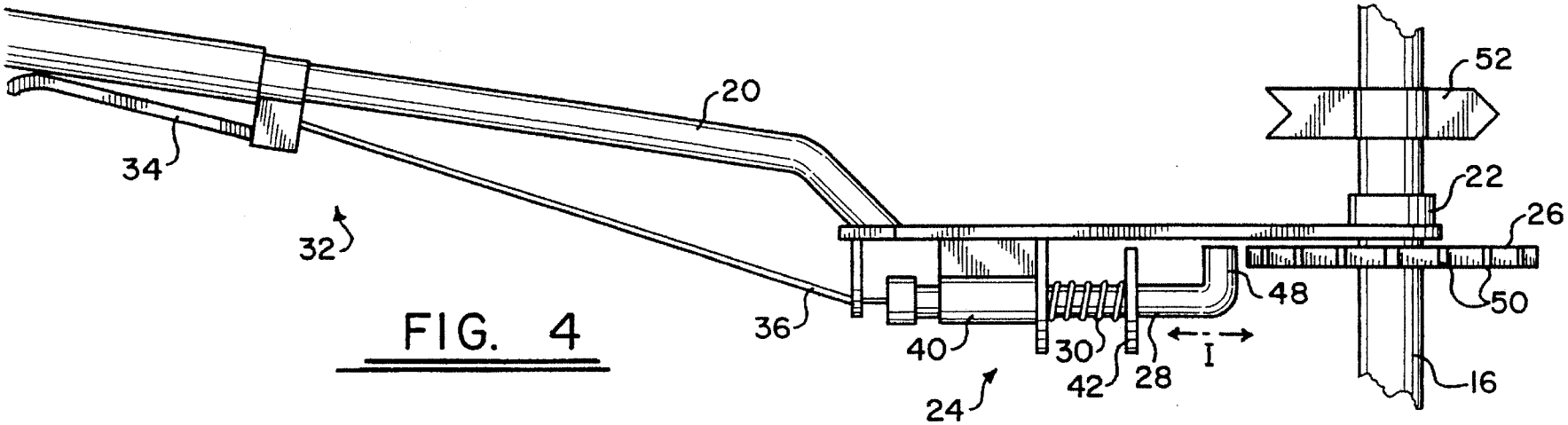
FIG. 4 is a side view of the steering apparatus similar to FIG. 3 except with the index member in a retracted position.

As shown in FIG. 3 the biasing spring 30 biases the indexing member 28 to an extended position in which a distal end 48 of the indexing member extends between teeth 50 formed on the sprocket 26. In this position, contact between the indexing member 28 and the sprocket teeth 50 prevents the handle 20 from moving with respect to the motor extension member 16. However, as shown in FIG. 4, the control lever 34 may be depressed, and through the control cable 36, overcome the biasing force of the spring 30, and pull the indexing member 28 to the left in the figure so that the distal end 48 of the indexing member is in a retracted position beyond the sprocket teeth 50. When the indexing member 28 is in the retracted position, the handle 20 may be pivoted on the pivot connection 22 about the boat motor extension member 16 and positioned in any desired orientation extending radially from the longitudinal axis of the boat motor extension member, in this case also the steering axis A. Thus with the indexing member 28 retracted as shown in FIG. 4, the handle 20 may be pivoted to a desired orientation with respect to the boat motor extension member 16 and then re-engaged to fix the handle in the desired orientation. The invention also preferably includes an indicator 52 associated with the boat motor extension member 16 or a portion of the pivot connection 22 connected to the boat motor extension member. The indicator 52 is aligned with the boat motor drive assembly 14 and indicates the direction of the drive assembly 14.

In operation, with the boat motor 12 positioned generally in the position shown in FIG. 1 with the drive assembly 14 submerged in the water and the extension member 16 extending substantially vertically, the handle 20 may be engaged through the handle engagement means 24 to rotate the boat motor about the steering axis A and thereby steer the boat to which the motor is connected. When it is desired to change the direction of the thrust T provided by the motor 12 by a large angle, the operator first moves the handle 20 through a smaller convenient angle and then depresses the control lever 34 to move the indexing member 28 to the retracted position shown in FIG. 4. At this point the operator may pivot the handle 20 with respect to the motor extension member 16 in the direction opposite the direction in which the motor 12 is being turned, and then re-engage the handle in another convenient position. With the handle 20 re-engaged, the operator may move the handle back in the direction in which the motor is being turned. These steps are repeated until the motor 12 is pivoted through the angle necessary to achieve the desired thrust direction.

The steering apparatus 10 according to the invention also allows the handle 20 to be positioned conveniently for steering. For example, the boat with which the motor 12 and steering apparatus 10 are to be used may include a seat that is off to the side of the position at which the motor may be connected. In this situation, the operator may depress the control lever 34, and adjust the position of the handle 20 to extend toward the seat when the motor is positioned generally to provide thrust in the desired direction. With the handle 20 engaged in this position extending toward the seat, the person sitting in the seat may more easily reach the handle to steer with the motor 12 without having to reach inconveniently and without having to get up from the seat.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the illustrated engagement means 24 includes the sprocket 26 and engagement member 28 to engage and disengage the handle 20, any other suitable mechanism may be employed to provide the desired function. An adjustable friction member associated with the handle 20 and extension member 16 could be used as an alternative to the illustrated engagement means 24. Also, any suitable control device may be substituted for the control lever 34 and cable arrangement.

I claim:

1. An outboard motor steering apparatus comprising:

(a) an elongated steering handle;

(b) a pivot connection connecting a proximal end of the steering handle to an extension member of the boat motor to be steered, the pivot connection enabling the steering handle to pivot freely about a motor steering axis with respect to the extension member; and (c) handle engagement means mounted on the handle and boat motor extension member and being movable between an engaged position and a released position, the handle engagement means for fixing the orientation of the handle with respect to the extension member about the motor steering axis when in the engaged position and enabling the handle to pivot freely about the pivot connection when in the released position.

2. The apparatus of claim 1 further including:

(a) a motor direction indicator associated with the pivot connection for indicating the direction of the thrust applied by the motor.

3. The apparatus of claim 1 wherein the handle engagement means comprises:

(a) a sprocket connected to the motor extension member and lying in a plane substantially perpendicular to the motor steering axis;

(b) an indexing member connected to the handle and movable between an extended position in which it extends between teeth associated with the sprocket and a retracted position in which it is withdrawn from between teeth of the sprocket;

(c) biasing means associated with the indexing member for biasing the indexing member to the extended position; and (d) index position control means connected to the handle and to the indexing member for moving the indexing member to the retracted position in response to an operating force applied to the position control means.

4. The apparatus of claim 3 wherein the index position control means includes:

(a) a control lever pivotally connected at a distal end of the handle; and (b) an elongated cable connected at one end to a proximal end of the control lever and at its opposite end to the indexing member.

5. In an electric trolling motor having a drive assembly for providing thrust and an extension member connected to the drive assembly and by which the drive assembly may be pivoted about a steering axis extending substantially perpendicular to the line of thrust produced by the drive assembly, the improvement comprising:

(a) an elongated steering handle;

(b) a pivot connection connecting a proximal end of the steering handle to the extension member, the pivot connection enabling the handle to pivot freely about the motor steering axis with respect to the extension member; and (c) handle engagement means mounted on the handle and the extension member and movable between an engaged position and a released position, the handle engagement means for fixing the orientation of the handle with respect to the extension member when in the engaged position and enabling the handle to pivot freely about the steering axis with respect to the motor extension member when in the released position.

6. The apparatus of claim 5 further including a motor direction indicator associated with the extension member for indicating the direction of thrust applied by the motor drive assembly.

7. The apparatus of claim 5 wherein the handle engagement means comprises:

(a) a sprocket connected to the motor extension member and lying in a plane perpendicular to the steering axis;

(b) an indexing member connected to the handle and movable between an extended position in which it extends between teeth of the sprocket and a retracted position in which it is withdrawn from between teeth of the sprocket;

(c) biasing means associated with the indexing member for biasing the indexing member to the extended position; and (d) index position control means connected to the handle and the indexing member for selectively moving the indexing member to the retracted position.

8. The apparatus of claim 7 wherein the index position control means includes:

(a) a control lever pivotally connected at a distal end of the handle; and (b) an elongated cable connected at one end to a proximal end of the control lever and at the opposite end to the indexing member.

* * * * *